US012005937B2

(12) United States Patent
Warwick et al.

(10) Patent No.: US 12,005,937 B2
(45) Date of Patent: Jun. 11, 2024

(54) CONFIGURABLE RAILROAD CAR

(71) Applicant: Gunderson LLC, Portland, OR (US)

(72) Inventors: James A. Warwick, North Richland Hills, TX (US); Daniel J. Schuller, North Richland Hills, TX (US); Peter L. Jones, Southlake, TX (US)

(73) Assignee: Gunderson LLC, Lake Oswego, OR (US)

( * ) Notice: Subject to any disclaimer, the term of this patent is extended or adjusted under 35 U.S.C. 154(b) by 791 days.

(21) Appl. No.: 17/168,723

(22) Filed: Feb. 5, 2021

(65) Prior Publication Data

US 2022/0250659 A1 Aug. 11, 2022

(51) Int. Cl.
*B61D 3/16* (2006.01)
*B61D 45/00* (2006.01)

(52) U.S. Cl.
CPC ..... *B61D 3/16* (2013.01); *B61D 45/001* (2013.01)

(58) Field of Classification Search
CPC .... B60P 1/64; B60P 3/00; B60P 3/035; B60P 7/00; B60P 7/06; B60P 7/08; B60P 7/0884; B60P 7/0892; B60P 7/12; B60P 7/135; B60P 7/16; B61D 3/00; B61D 3/005; B61D 3/06; B61D 3/16; B61D 3/166; B61D 17/00; B61D 17/06; B61D 17/10; B61D 45/00; B61D 45/001; B61D 45/002; B61D 45/003; B61D 49/00; B65D 85/00; B65D 85/20; B65D 85/54
See application file for complete search history.

(56) References Cited

U.S. PATENT DOCUMENTS

| | | | |
|---|---|---|---|
| 276,017 | A | 4/1883 | Foster |
| 2,620,748 | A | 12/1952 | Shields |
| 2,810,602 | A | 10/1957 | Abrams |
| 2,977,900 | A | 4/1961 | Farrar |
| 3,091,348 | A | 5/1963 | Neuhauser |
| 3,197,236 | A | 7/1965 | Burton |
| 3,392,682 | A | 7/1968 | Francis |
| 3,581,674 | A | 6/1971 | O'Leary |
| 3,693,554 | A | 9/1972 | O'Leary et al. |

(Continued)

FOREIGN PATENT DOCUMENTS

| | | | |
|---|---|---|---|
| CA | 2328672 | A1 | 6/2002 |
| CN | 201890231 | U | 7/2011 |

(Continued)

OTHER PUBLICATIONS

"CR 606306 Class G41 Photo", Conrail Historical Society, Inc., Conrail Photo Archive, photo of railcar located at Altoona, PA, Copyright Grant Lowry, posted May 25, 2009.

(Continued)

*Primary Examiner* — Zachary L Kuhfuss
*Assistant Examiner* — Heaven R Buffington
(74) *Attorney, Agent, or Firm* — Neal, Gerber & Eisenberg LLP

(57) ABSTRACT

A configurable railroad car including a plurality of multi-orientation coil/slab supports that are configured to be positioned on, oriented on, and securely attached to the floor of the railroad car in different sets of positions and orientations to enable the railroad car to transport different products such as coils, elongated slabs, a mix of coils and elongated slabs, or other products.

17 Claims, 15 Drawing Sheets

(56) References Cited

U.S. PATENT DOCUMENTS

| | | | | |
|---|---|---|---|---|
| 3,715,993 | A | 2/1973 | Orlik | |
| 4,102,274 | A | 7/1978 | Feary et al. | |
| 4,930,426 | A | 6/1990 | Saxton et al. | |
| 5,054,403 | A | 10/1991 | Hill et al. | |
| 5,170,717 | A | 12/1992 | Richmond et al. | |
| 5,170,718 | A | 12/1992 | Hill et al. | |
| 5,379,702 | A | 1/1995 | Saxton et al. | |
| 5,611,285 | A | 3/1997 | Saxton | |
| 6,231,284 | B1 * | 5/2001 | Kordel | B65D 90/006 108/55.3 |
| 6,523,484 | B2 | 2/2003 | Saxton et al. | |
| 6,679,187 | B2 | 1/2004 | Dorian et al. | |
| 6,739,268 | B2 | 5/2004 | Al-kaabi et al. | |
| 7,077,269 | B2 | 7/2006 | Kissell | |
| 7,234,904 | B2 | 6/2007 | Al-kaabi et al. | |
| 7,757,610 | B2 | 7/2010 | Saxton et al. | |
| 8,011,865 | B2 | 9/2011 | Anderson | |
| 8,033,768 | B2 | 10/2011 | Anderson | |
| 8,177,461 | B2 | 5/2012 | Schutz et al. | |
| 8,308,409 | B2 | 11/2012 | Anderson | |
| 8,366,361 | B1 | 2/2013 | Landrum | |
| 8,388,285 | B2 | 3/2013 | Langh | |
| 9,387,864 | B2 | 7/2016 | Lydic et al. | |
| 10,315,667 | B2 | 6/2019 | Thompson et al. | |
| 2003/0230214 | A1 | 12/2003 | Forbes | |
| 2014/0013995 | A1 * | 1/2014 | Kutschera | B61D 3/16 105/378 |
| 2015/0083020 | A1 | 3/2015 | Lydic et al. | |
| 2017/0217450 | A1 | 8/2017 | Thompson et al. | |
| 2019/0256111 | A1 | 8/2019 | Thompson et al. | |
| 2020/0101987 | A1 * | 4/2020 | Kress | B61D 3/16 |
| 2021/0261172 | A1 | 8/2021 | Gachhadar et al. | |

FOREIGN PATENT DOCUMENTS

| | | | | |
|---|---|---|---|---|
| FR | 2497162 | A1 | 7/1982 | |
| RU | 111082 | U1 | 12/2011 | |
| UA | 8657 | U | 8/2005 | |
| WO | WO-9744220 | A1 * | 11/1997 | B60P 7/0892 |
| WO | WO-2020162283 | A1 * | 8/2020 | |

OTHER PUBLICATIONS

"CR 606306 Class G41 Photo", Conrail Historical Society, Inc., Conrail Photo Archive, photo of railcar located at Baden (East Conway), PA 1993/94, Copyright Grant Lowry 2016.

"CR 606306 Class G41 Photo", Conrail Historical Society, Inc., Conrail Photo Archive, photo of railcar located at Cove, PA 1987/88, Copyright Grant Lowry 2016.

"CR 606306 Class G41 Photo", Conrail Historical Society, Inc., Conrail Photo Archive, photo of railcar seen Jul. 1996.

"CR 606306 Class G41 Photo", Conrail Historical Society, Inc., Conrail Photo Archive, photo of railcar seen Jun. 1994, built Dec. 1965.

"CR 622585 Class G41 Photo", Conrail Historical Society, Inc., Conrail Photo Archive, photo of railcar seen at Enola, PA 1991/92, Copyright Grant Lowry 2016.

"CR 622849 Class G41 Photo", Conrail Historical Society, Inc., Conrail Photo Archive, photo of railcar Jul. 1996.

"CR 622849 Glass G41 Photo", Conrail Historical Society, Inc., Conrail Photo Archive, photo of railcar Apr. 1994.

"Shimmns S10B 4-Axle Coil Steel Product Wagon", Greenbrier Europe, available prior to May 7, 2019.

"Shmmnss 4 Axle Hot Coil Steel Product Wagon", Greenbrier Europe, available prior to May 7, 2019.

Assorted Known Existing Rail Cars, Dec. 2020.

* cited by examiner

CONFIGURABLE RAILROAD CAR

BACKGROUND

The railroad industry employs a variety of different known railroad cars for transporting different products. For example, various known railroad cars are configured to transport steel coils, and various known railroad cars are configured to transport elongated hot steel slabs.

The railroad industry loading rules (and particularly the AAR Open Top Loading Rules Section 1, Part 1.5.5.2) require the use of anti-skid matting between a steel coil and a lateral (or sawtooth) trough during transportation. Such anti-skid matting typically have a maximum temperature range of less than 400 degrees Fahrenheit, which is below the loading temperature of hot steel slabs, which are typically above 400 degrees Fahrenheit. Accordingly, such anti-skid matting cannot be employed to support hot steel slabs.

There is a continuing need to provide railroad cars that can transport multiple different products such as steel coils and elongated hot steel slabs.

SUMMARY

Various embodiments of the present disclosure provide a configurable railroad car including a plurality of multi-orientation coil/slab supports that are configured to be positioned and oriented to enable the railroad car to transport different products. Various embodiments of the present disclosure also relate to such multi-orientation coil/slab supports for a railroad car.

More specifically, various example embodiments of the present disclosure provide a configurable railroad car including: (1) a frame, trucks supporting the frame, wheels supporting the trucks, a floor supported by the frame, and spaced apart end walls supported by the frame, and (2) a plurality of multi-orientation coil/slab supports that are configured to be positioned on and securely attached to the floor at different positions and in different orientations to enable the railroad car to be quickly and easily converted to be able to transport different products. In one such set of positions and orientations of the multi-orientation coil/slab supports on the floor, the configurable car can transport coils such as steel coils. In another such set of positions and orientations of the multi-orientation coil/slab supports on the floor, the configurable car can transport elongated hot steel slabs. In another such set of positions and orientations of the multi-orientation coil/slab supports on the floor, the configurable car can transport one or more steel coils and one or more elongated hot steel slabs. In another such set of positions and orientations of the multi-orientation coil/slab supports on the floor, the configurable car can transport other products. Accordingly, the different sets of positions and orientations of the multi-orientation coil/slab supports enable the railroad car of the present disclosure to be quickly and easily converted for transporting different products.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
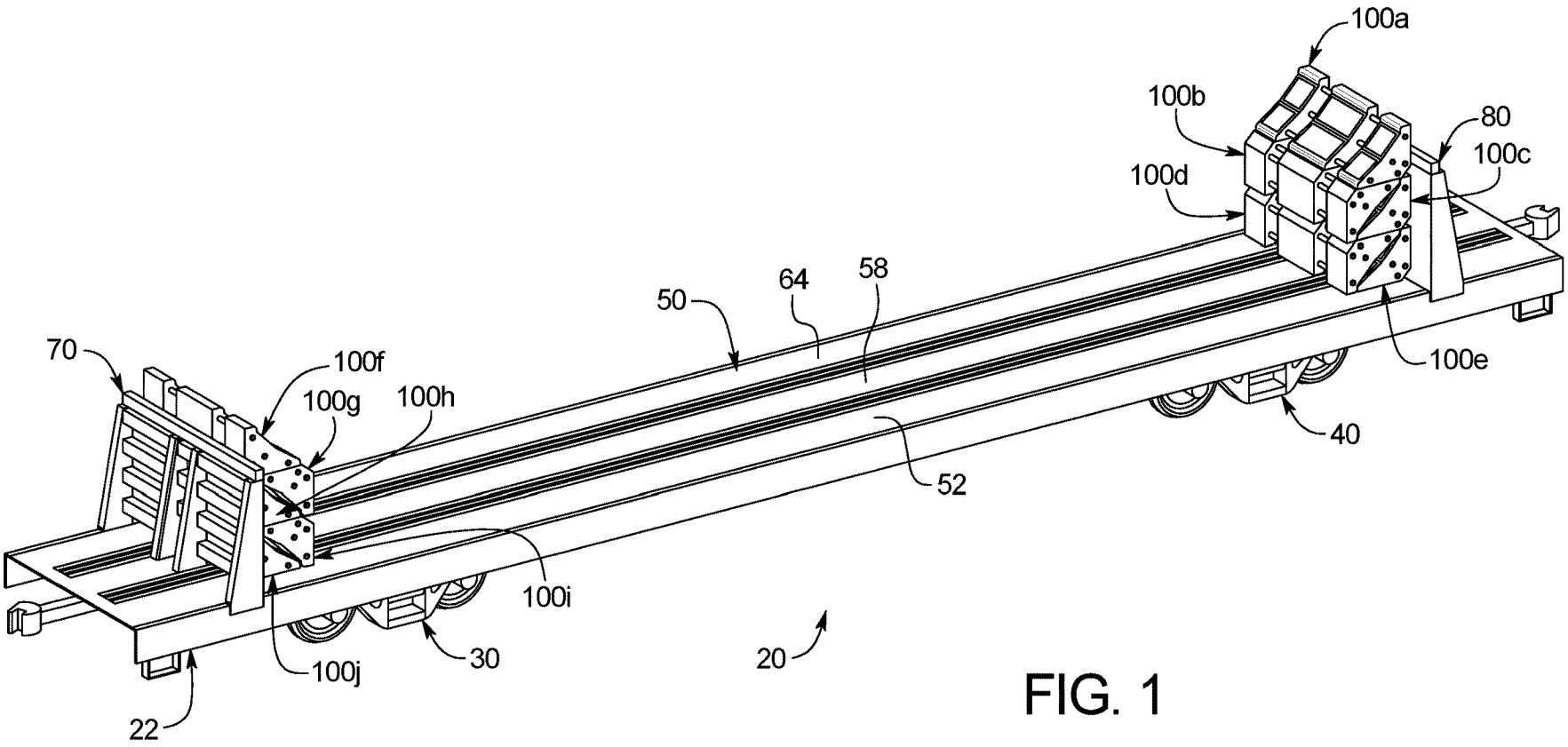
FIG. 1 is a top perspective view of a configurable railroad car of one example embodiment of the present disclosure, showing the multi-orientation coil/slab supports in stacked storage positions and orientations at the respective ends of the railroad car adjacent the end walls, and the configurable railroad car arranged to transport products (not shown) on the floor of the railroad car between the stacked multi-orientation coil/slab supports.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Referring now to the drawings, FIGS. 1, 2, 3, 4, 5, 6, 7, 8, and 9 illustrate a configurable railroad car 20 of one example embodiment of the present disclosure. The illustrated example railroad car 20 generally includes: (1) a frame 22; (2) spaced apart trucks 30 and 40 supporting the frame 22; (3) a plurality of wheels (not labeled) supporting the trucks 30 and 40; (4) a floor 50 suitably connected to and supported by the frame 22; (5) a first end wall 70 suitably connected to and supported by the frame 22 and the floor 50; (6) a second end wall 80 suitably connected to and supported by the frame 22 and the floor 50; (8) a plurality of support securements such as support securements 90 and 92; and (9) a plurality of multi-orientation coil/slab supports 100*a*, 100*b*, 100*c*, 100*d*, 100*e*, 100*f*, 100*g*, 100*h*, 100*i*, and 100*j*. Each of the plurality of multi-orientation coil/slab supports 100*a*, 100*b*, 100*c*, 100*d*, 100*e*, 100*f*, 100*g*, 100*h*, 100*i*, and 100*j* is independently movable to any one of a plurality of different positions and a plurality of different orientations on and relative to the floor 50 as further described below. The configurable railroad car 20 is configurable by repositioning and re-orientating each of the multi-orientation coil/slab supports 100*a*, 100*b*, 100*c*, 100*d*, 100*e*, 100*f*, 100*g*, 100*h*, 100*i*, and 100*j* on the floor 50 of the railroad car 20 and securely attaching the each of these multi-orientation coil/slab supports 100*a*, 100*b*, 100*c*, 100*d*, 100*e*, 100*f*, 100*g*, 100*h*, 100*i*, and 100*j* in the respective positions and orientations.

Figure 3:
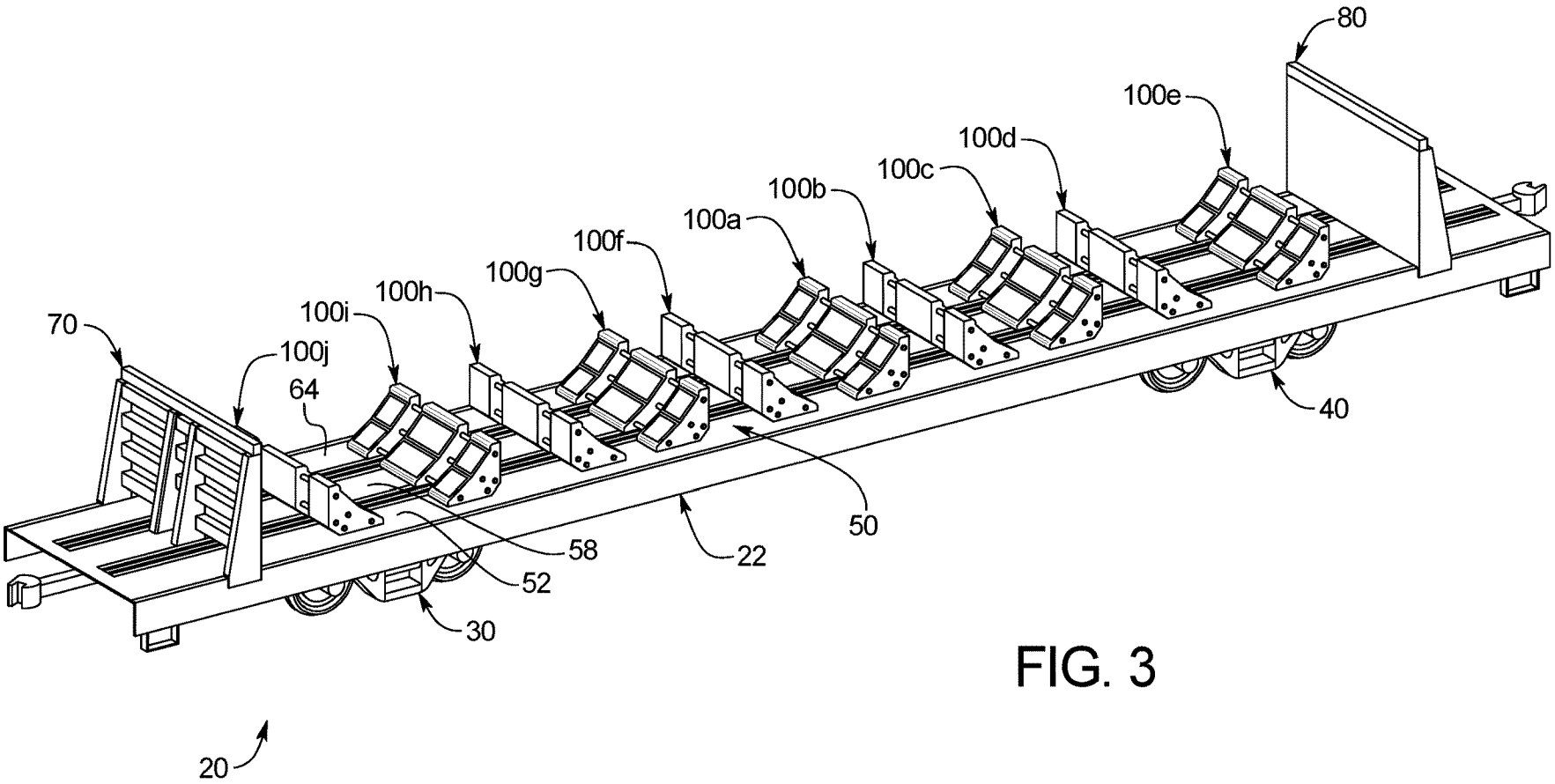
FIG. 3 is a top perspective view of the configurable railroad car of FIG. 1, showing the multi-orientation coil/slab supports of FIG. 1 in spaced apart coil supporting positions and in coil supporting orientations on the floor of the railroad car, such that the railroad car is arranged to transport a plurality of coils such as steel coils.
Figure 4:
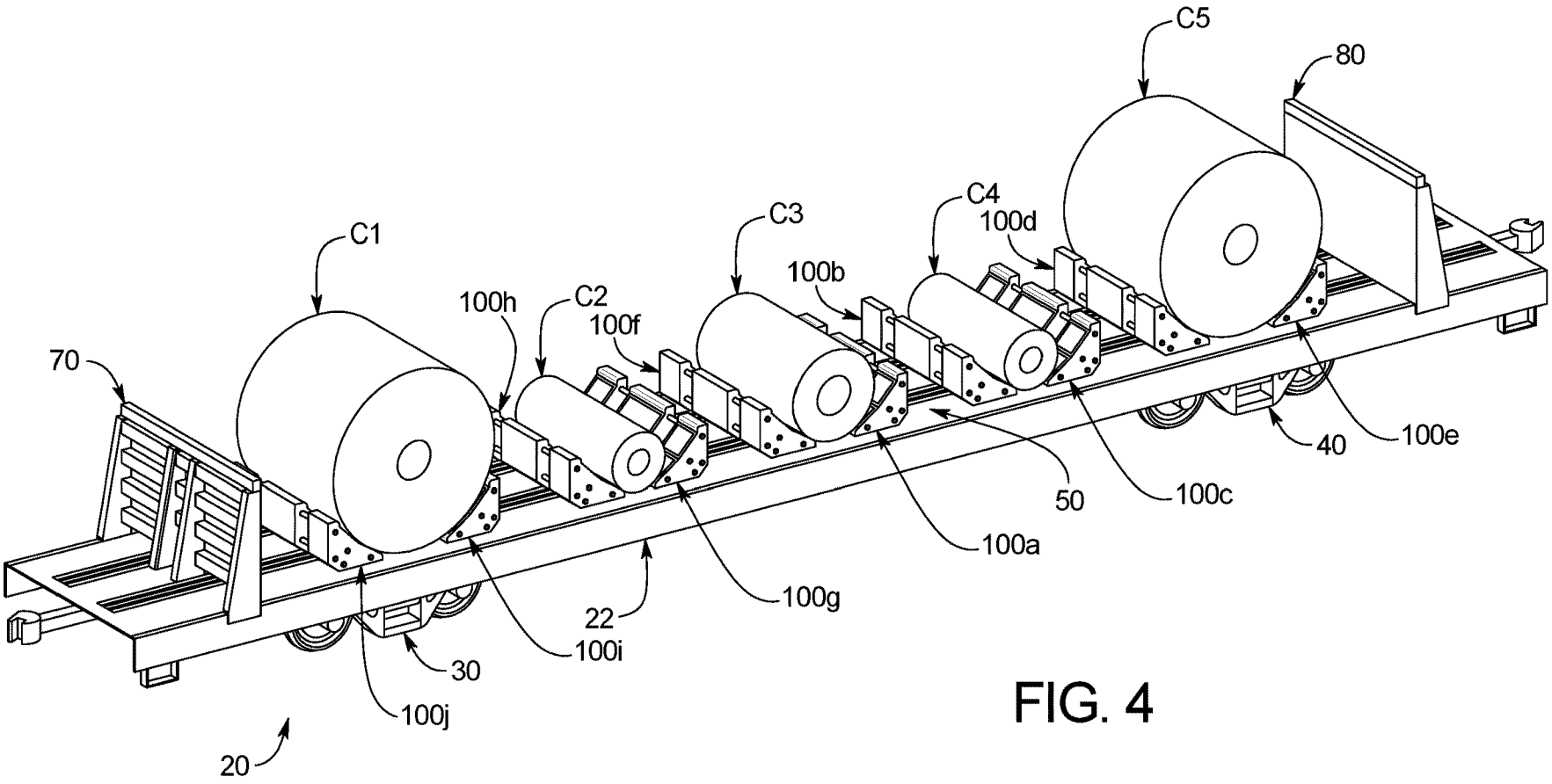
FIG. 4 is a top perspective view of the configurable railroad car of FIG. 1, showing the multi-orientation coil/slab supports of FIG. 1 in the spaced apart coil supporting positions and in the coil supporting orientations on the floor of the railroad car as in FIG. 3, and the railroad car transporting a plurality of steel coils supported by the multi-orientation coil/slab supports.
Figure 5:
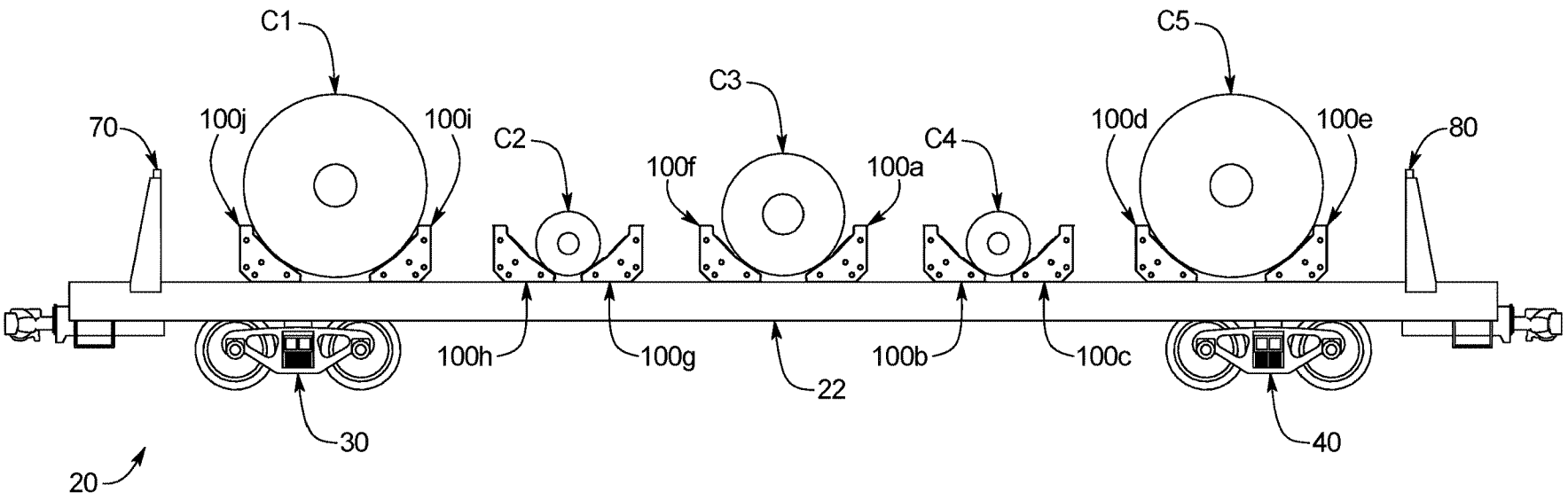
FIG. 5 is a side view of the configurable railroad car of FIG. 1, showing the multi-orientation coil/slab supports of FIG. 1 in the spaced apart coil supporting positions and in the coil supporting orientations on the floor of the railroad car as in FIGS. 3 and 4, and the railroad car transporting a plurality of steel coils supported by the multi-orientation coil/slab supports.

More specifically, the multi-orientation coil/slab supports 100*a*, 100*b*, 100*c*, 100*d*, 100*e*, 100*f*, 100*g*, 100*h*, 100*i*, and 100*j* are configured to be in coil supporting positions and coil supporting orientations on the floor 50 (and securely attached to the floor 50) to transport coils such as steel coils C1, C2, C3, C4, and C5 as shown in FIGS. 3, 4, 5, and 9. The quantity of the multi-orientation coil/slab supports may vary and the coil supporting positions on the floor 50 may vary based on the quantity of coils being transported and the size of such coils in accordance with the present disclosure. The multi-orientation coil/slab supports 100*a*, 100*b*, 100*c*, 100*d*, 100*e*, 100*f*, 100*g*, 100*h*, 100*i*, and 100*j* can be configured in the coil supporting positions and coil supporting orientations on the floor 50 to transport coils of different sizes (such as different outer diameters and different widths). In the coil supporting orientations, the anti-skid matting (such as anti-skid matting 120, 122, 150, 152, 180, and 182 of multi-orientation coil/slab support 100*a*) of each of the multi-orientation coil/slab supports are positioned to be engaged by the respective coil (such as Coil C3 as shown in FIGS. 4 and 5) for the purposes described below.

Figure 6:
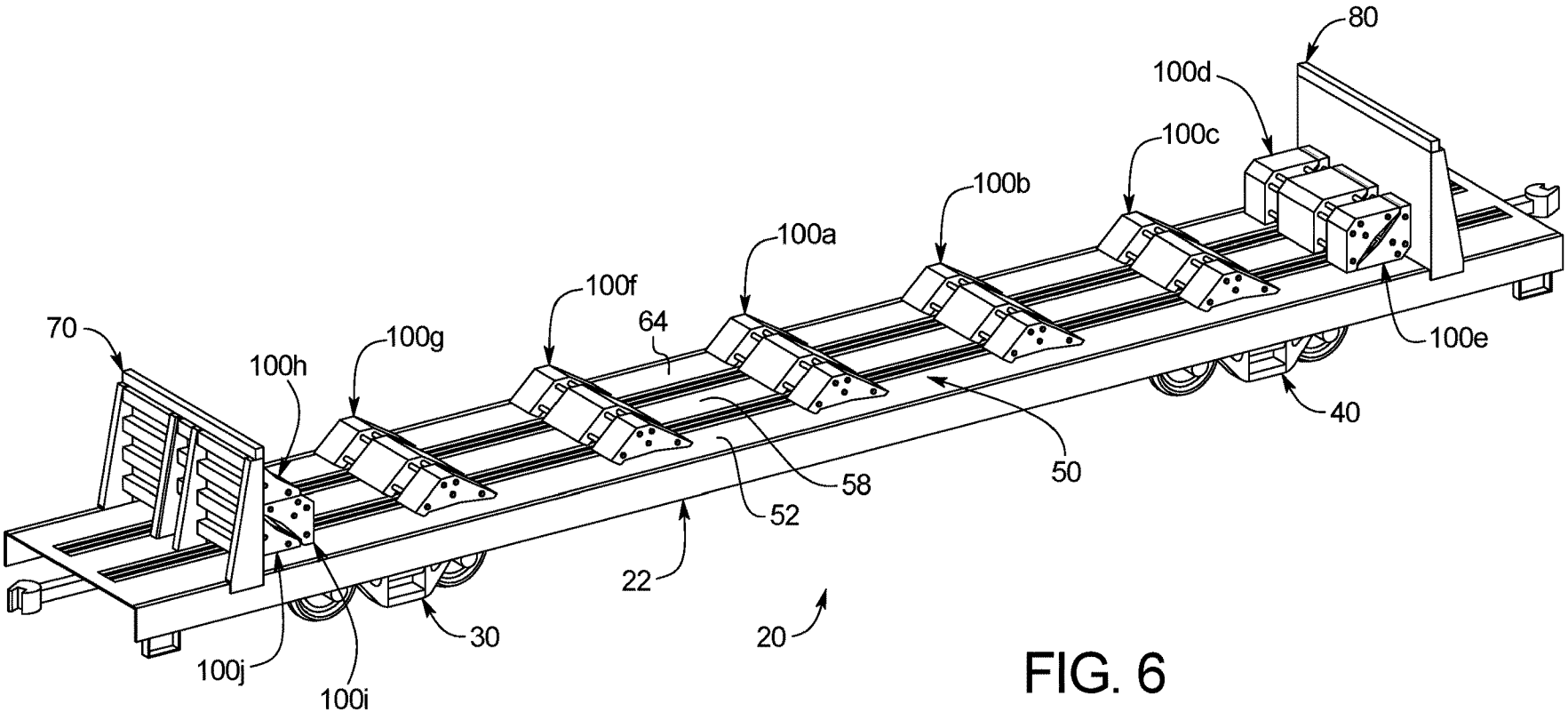
FIG. 6 is a top perspective view of the configurable railroad car of FIG. 1, showing five of the multi-orientation coil/slab supports of FIG. 1 in spaced apart slab supporting positions and in slab supporting orientations on the floor of the railroad car, and such that the railroad car is arranged to transport a plurality of elongated slabs such as elongated hot steel slabs.
Figure 7:
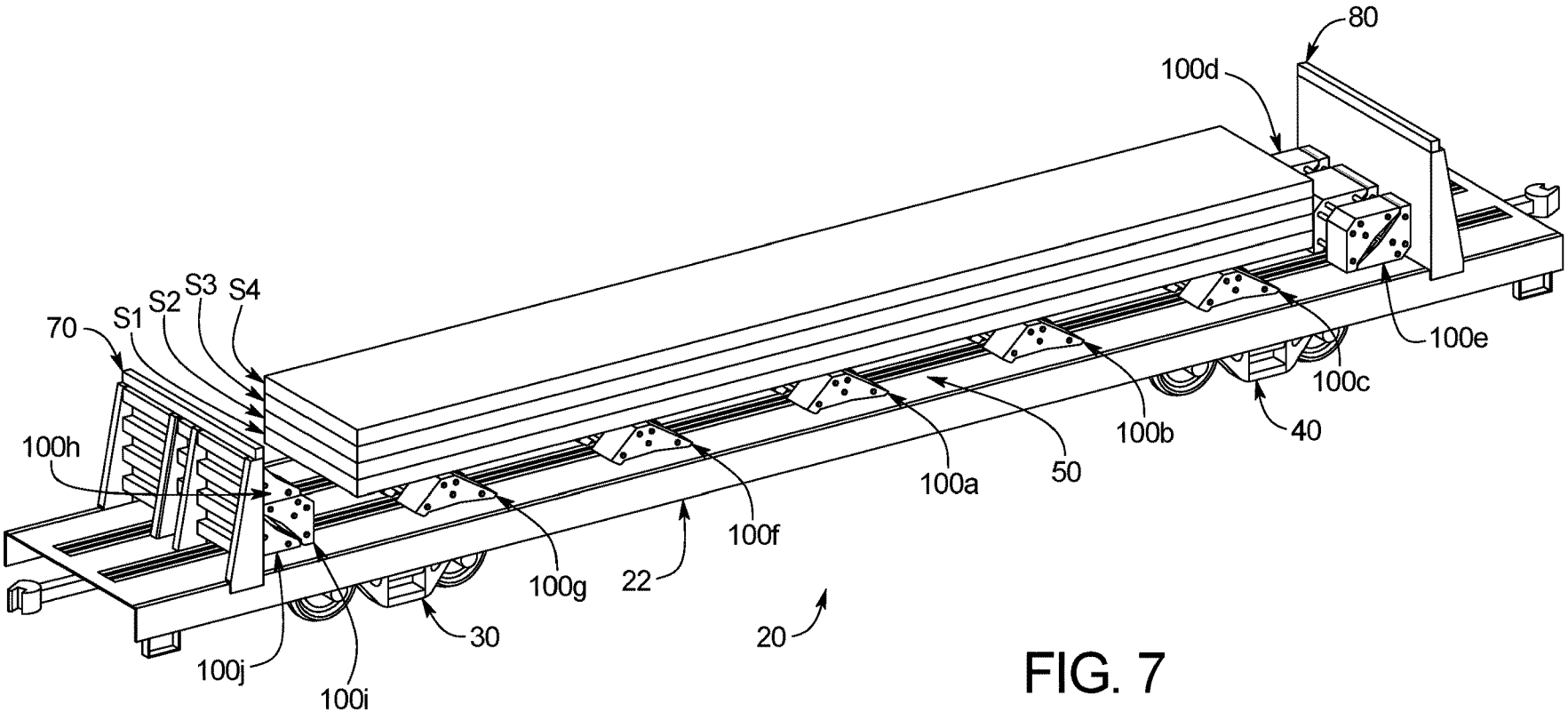
FIG. 7 is a top perspective view of the configurable railroad car of FIG. 1, showing five of the multi-orientation coil/slab supports of FIG. 1 in the spaced apart slab supporting positions and in the slab supporting orientations on the floor of the railroad car as in FIG. 6, and the railroad car transporting a plurality of elongated hot steel slabs supported by the multi-orientation coil/slab supports.
Figure 8:
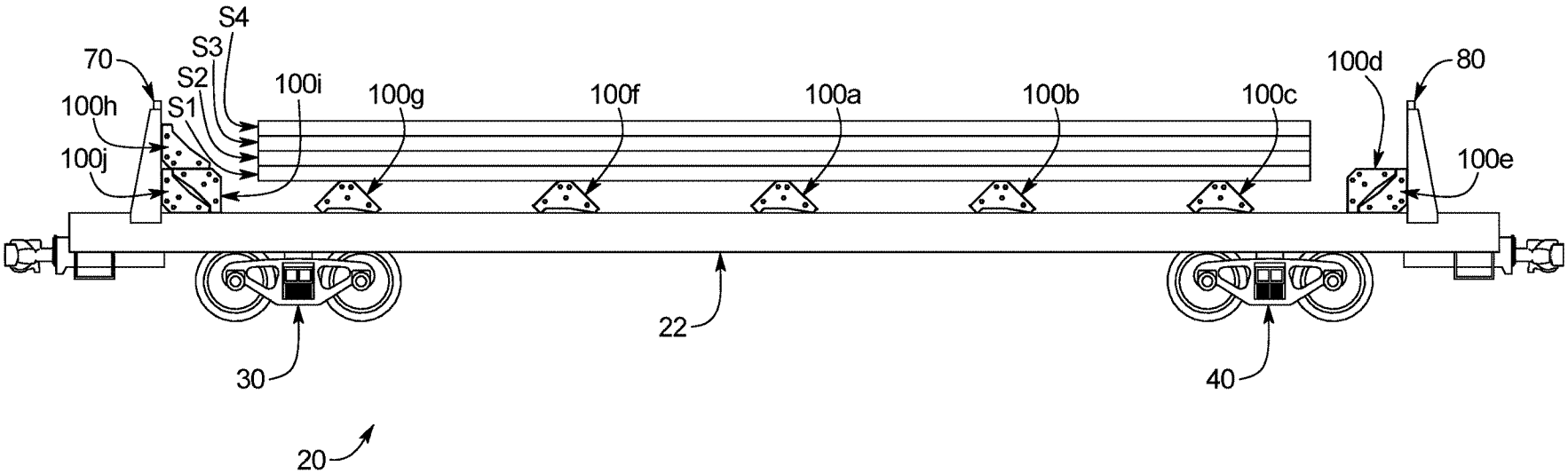
FIG. 8 is a side view of the configurable railroad car of FIG. 1, showing five of the multi-orientation coil/slab supports of FIG. 1 in the spaced apart slab supporting positions and in the slab supporting orientations on the floor of the railroad car as in FIGS. 6 and 7, and the railroad car transporting a plurality of elongated hot steel slabs supported by the multi-orientation coil/slab supports.

The multi-orientation coil/slab supports 100*a*, 100*b*, 100*c*, 100*d*, 100*e*, 100*f*, 100*g*, 100*h*, 100*i*, and 100*j* are also configured to be in slab supporting positions and slab supporting orientations on the floor 50 (and securely attached to the floor 50) to transport elongated slabs such as elongated hot steel slabs S1, S2, S3, and S4, as shown in FIGS. 6, 7, and 8. The quantity of the multi-orientation coil/slab supports may vary and the slab supporting positions on the floor 50 may vary based on the quantity of slabs being transported and the size of such slabs in accordance with the present disclosure. The multi-orientation coil/slab supports 100*a*, 100*b*, 100*c*, 100*d*, 100*e*, 100*f*, 100*g*, 100*h*, 100*i*, and 100*j* can be configured in the slab supporting positions and slab supporting orientations on the floor 50 to transport elongated slabs of different lengths and or widths. In the slab supporting orientations, the anti-skid matting (such as anti-skid matting 120, 122, 150, 152, 180, and 182 of multi-orientation coil/slab support 100*a*) of each of the multi-orientation coil/slab supports are positioned facing downwardly away from the elongated hot steel slabs (such as slab S1) as shown in FIGS. 6, 7, and 8). This positioning of the anti-skid matting in this orientation prevents the elongated hot steel slabs from engaging such anti-skid matting and from causing any deformation or degradation of such anti-skid matting, as further described below. This orientation enables the railroad car 20 to be configured to transport elongated hot steel slabs. It should be appreciated that these slabs are considered hot (such as in a temperature range of 400 degrees Fahrenheit to 1,000 degrees Fahrenheit) because they have been recently formed in a metal working process, and are transported before cooling. It should also be appreciated that the multi-orientation coil/slab supports 100*a*, 100*b*, 100*c*, 100*d*, 100*e*, 100*f*, 100*g*, 100*h*, 100*i*, and 100*j* in the slab supporting positions and the slab supporting orientations provide air spaces under the hot elongated steel slabs to enhance cooling.

The multi-orientation coil/slab supports 100*a*, 100*b*, 100*c*, 100*d*, 100*e*, 100*f*, 100*g*, 100*h*, 100*i*, and 100*j* are also configured to be in a combination of: (a) coil supporting positions and coil supporting orientations on the floor 50 (and securely attached to the floor 50) to transport one or more coils; and (b) slab supporting positions and slab supporting orientations on the floor 50 (and securely attached to the floor 50) to transport one or more elongated slabs.

Figure 2:
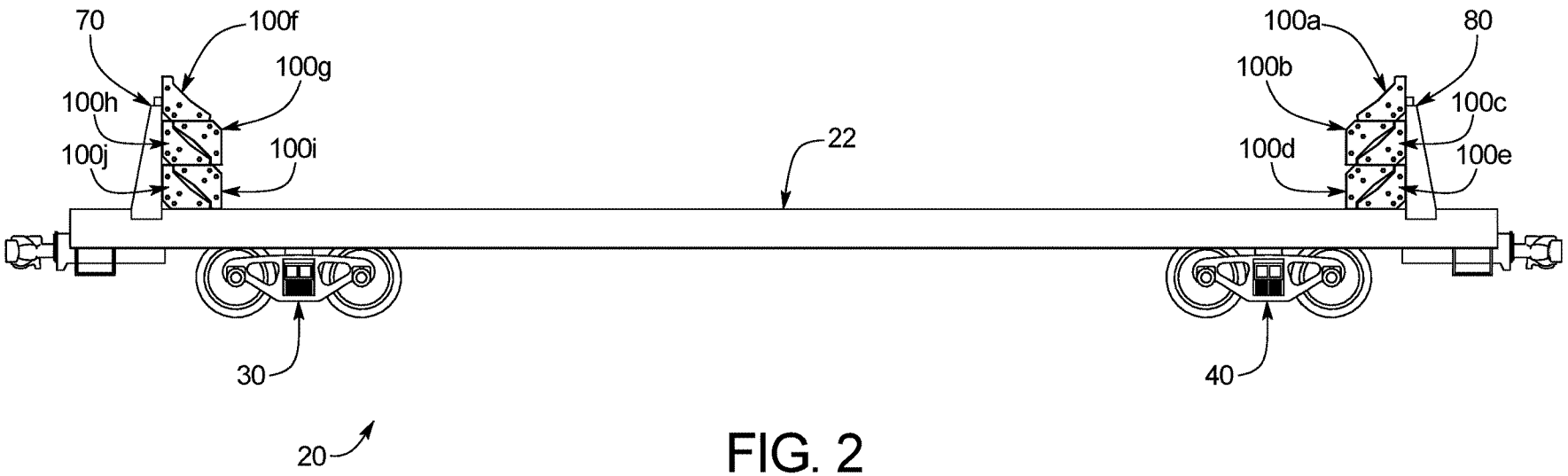
FIG. 2 is a side view of the configurable railroad car of FIG. 1, showing the multi-orientation coil/slab supports of FIG. 1 in the stacked storage positions and orientations at the respective ends of the railroad car adjacent the end walls, and the configurable railroad car arranged to transport products (not shown) on the floor of the railroad car between the stacked multi-orientation coil/slab supports.

The multi-orientation coil/slab supports 100*a*, 100*b*, 100*c*, 100*d*, 100*e*, 100*f*, 100*g*, 100*h*, 100*i*, and 100*j* are also configured to be in stacked third positions and stacked orientations on the floor 50 (and securely attached to the floor 50) to transport other products (not shown) on the floor 20 between the end wall 70 and 80, as shown in FIGS. 1 and 2. The quantity of the multi-orientation coil/slab supports may vary and the coil supporting positions on the floor 50 may vary based on the other products being transported and the size of such other products in accordance with the present disclosure. For example, certain of the multi-orientation coil/slab supports may additionally be positioned, oriented, and attached at the longitudinal center of the railroad cars for certain shorter transported products.

The configurations and/or sizes of the configurable railroad car 20 and these components thereof may vary in accordance with the present disclosure. For brevity, the configurable railroad car 20 may sometimes be referred to herein as "the railroad car" or "the car."

Turning now more specifically to the various components of the car 20, the frame 22 may be any suitable frame as is known in the railroad industry or that may be developed in the future. The frame 22 extends the length of the railroad car 20 and is configured to rest on and be coupled to the trucks 30 and 40 in a suitable manner. The railroad car 20 of the present disclosure may include various other conventional railroad car components attached to the frame 22 or supported by the frame 22.

The trucks 30 and 40 supporting the frame 22 and the wheels that support the trucks 30 and 40 may be any suitable trucks and wheels as are known in the railroad industry or that may be developed in the future.

The floor 50 is connected to and supported by the frame 22 in a suitable manner. The floor 50 may be any suitable floor as is known in the railroad industry or that may be developed in the future. In this illustrated example embodiment, as best shown in FIGS. 1, 3, 6, and 9, the floor 50 includes: (1) an elongated first section 52; (2) an elongated second section 58; (3) an elongated third section 64; (4) elongated rails 54*a*, 54*b*, and 54*c* between the elongated first section 52 and the elongated second section 58; and (5) elongated rails 60*a*, 60*b*, and 60*c* between the elongated second section 58 and the elongated third section 64. The elongated rails 54*a* and 54*b* define a first elongated opening 56*a* in the floor 50. The elongated rails 54 and 54*c* define a second elongated opening 56*b* in the floor 50. The elongated rails 60*a* and 60*b* define a third elongated opening 62*a* in the floor 50. The elongated rails 60*b* and 60*c* define a fourth elongated opening 62*b* in the floor 50. The elongated openings 56*a*, 56*b*, 62*a*, and 62*b* are configured such that the support securement (such as support securements 90 and 92) can extend through such openings 56*a*, 56*b*, 62*a*, and 62*b* at suitable positions along the length of the floor 50 to selectively securely attach the plurality of multi-orientation coil/slab supports 100*a*, 100*b*, 100*c*, 100*d*, 100*e*, 100*f*, 100*g*, 100*h*, 100*i*, and 100*j* to the floor 50, as further described below.

Figure 9:
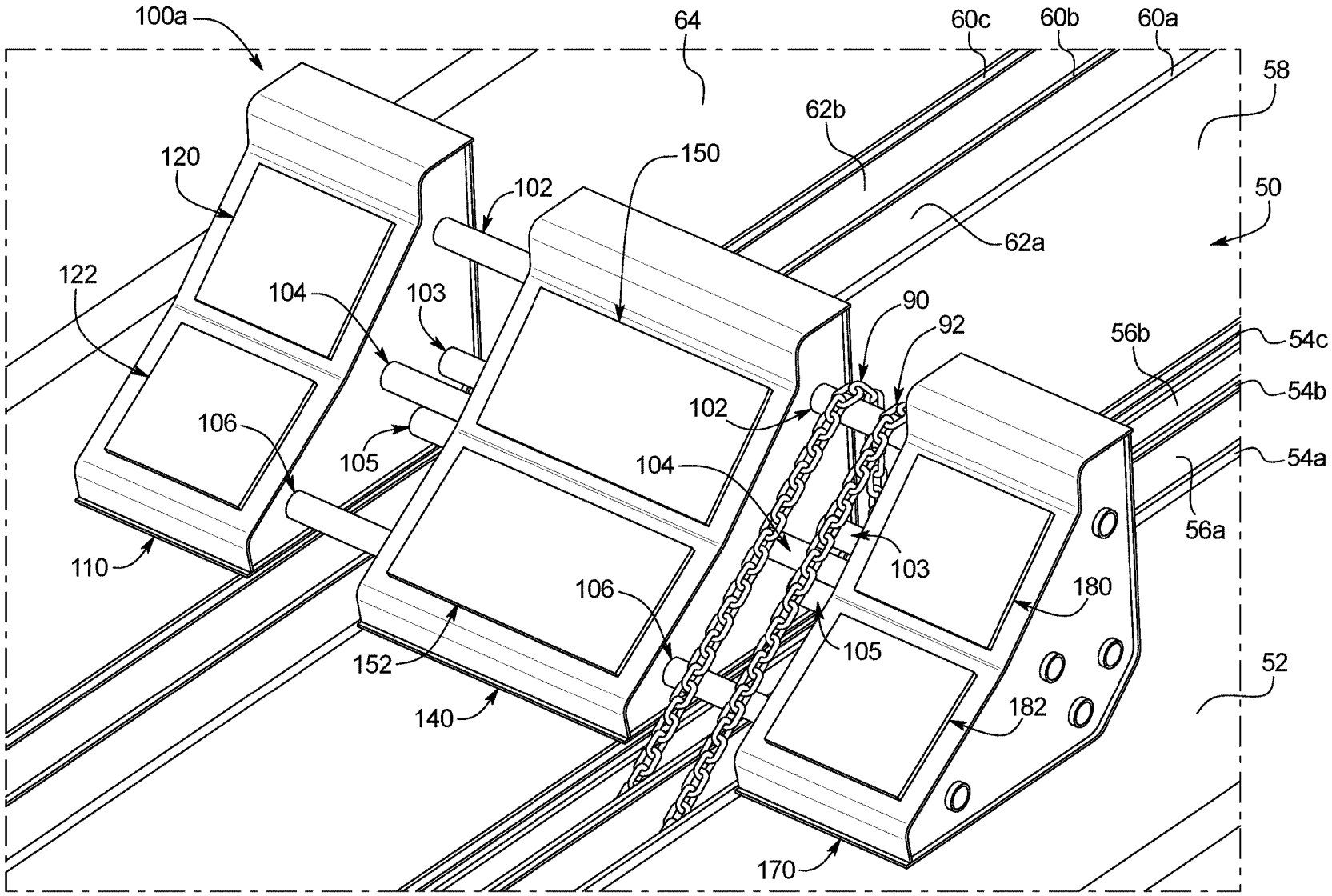
FIG. 9 is an enlarged top perspective view of one of the multi-orientation coil/slab supports of FIG. 1 in a coil supporting position and in a coil supporting orientation on the floor of the railroad car (shown in fragmentary).
Figure 10:
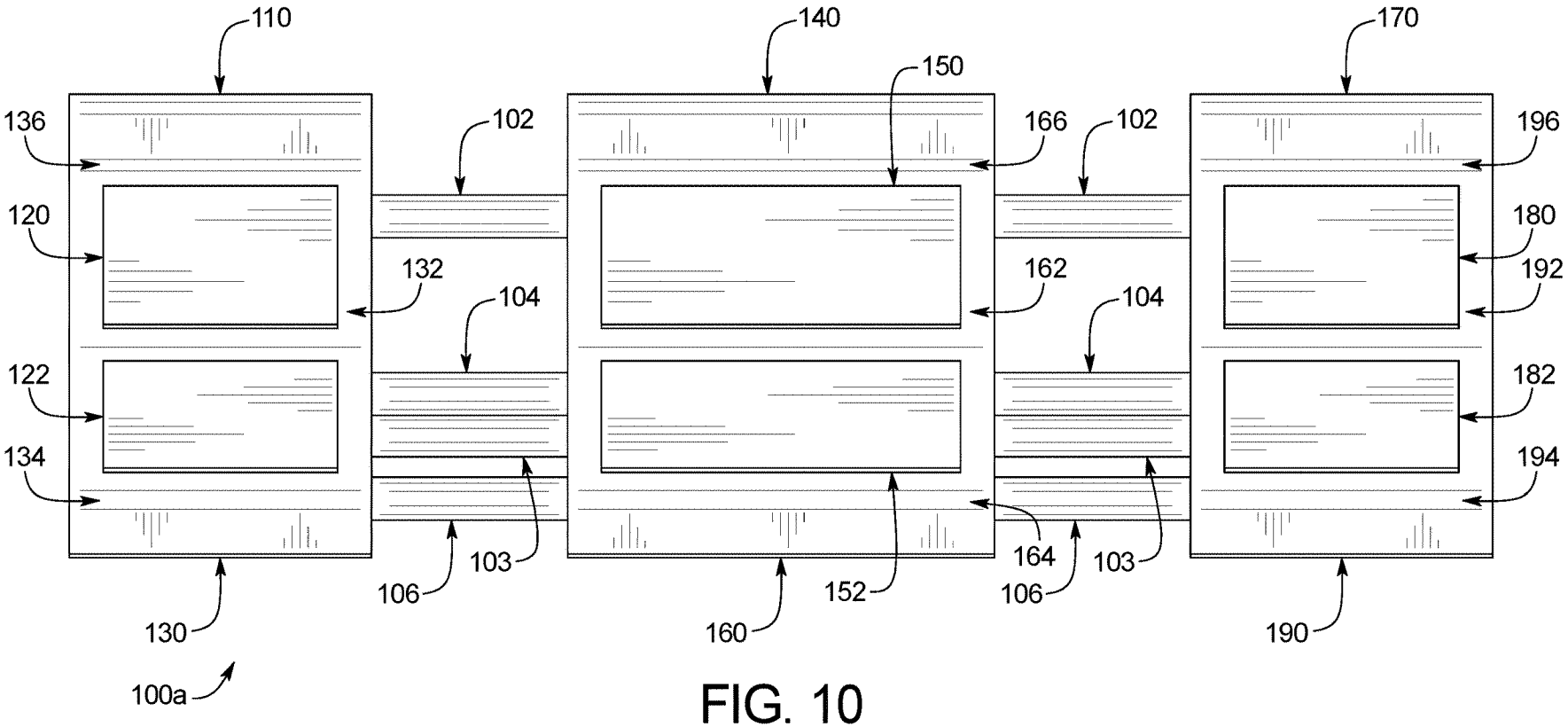
FIG. 10 is an enlarged front view of the multi-orientation coil/slab support of FIG. 9 in a coil supporting orientation.
Figure 11:
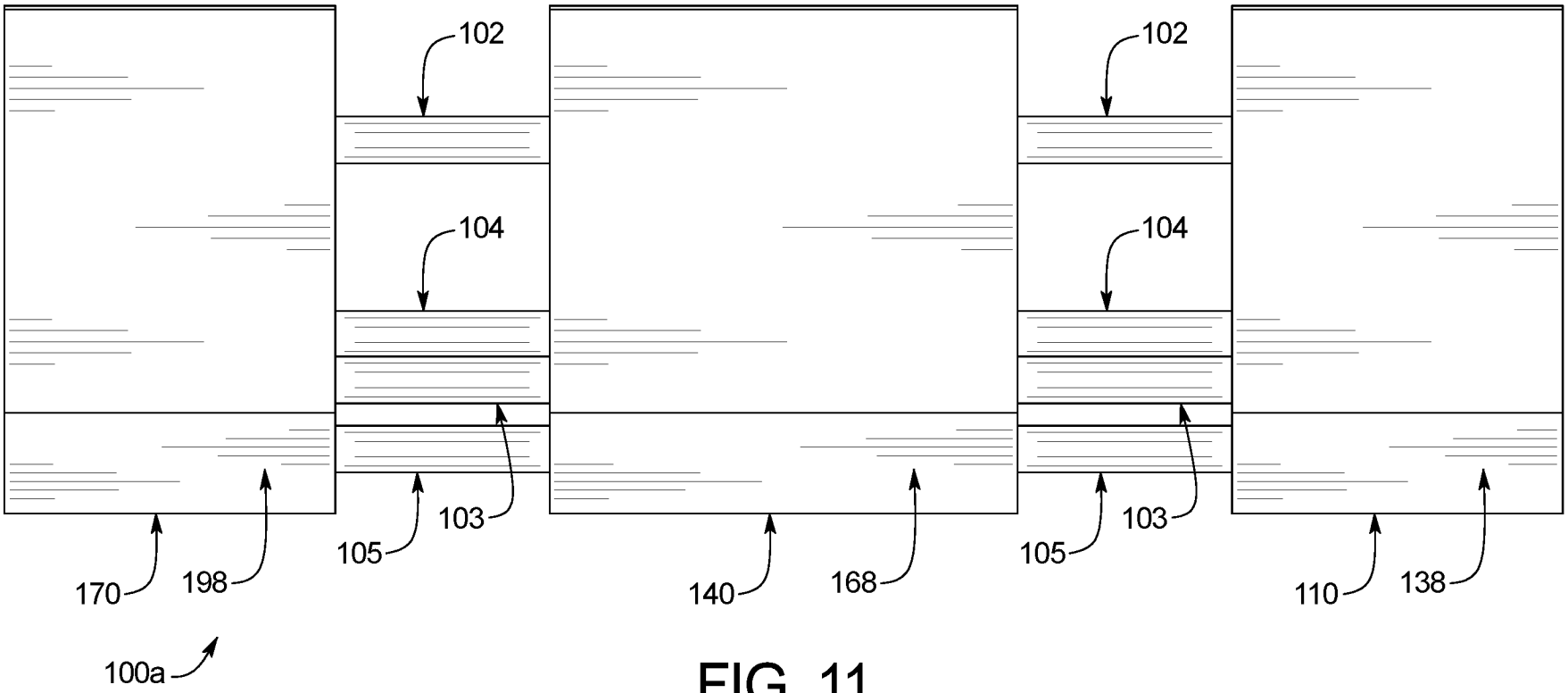
FIG. 11 is an enlarged rear view of the multi-orientation coil/slab support of FIG. 9 in a coil supporting orientation.
Figure 12:
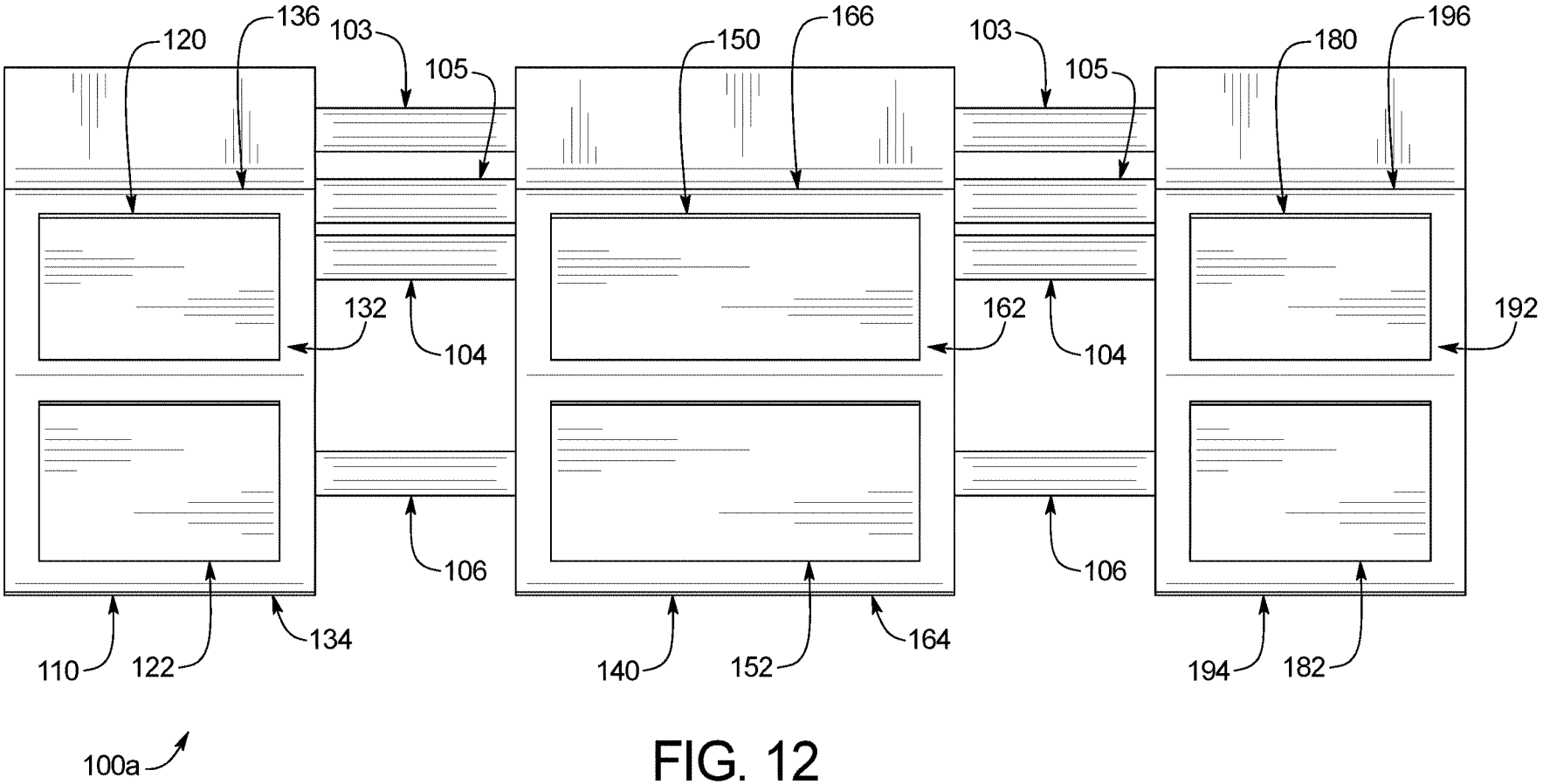
FIG. 12 is an enlarged top view of the multi-orientation coil/slab support of FIG. 9 in a coil supporting orientation.
Figure 13:
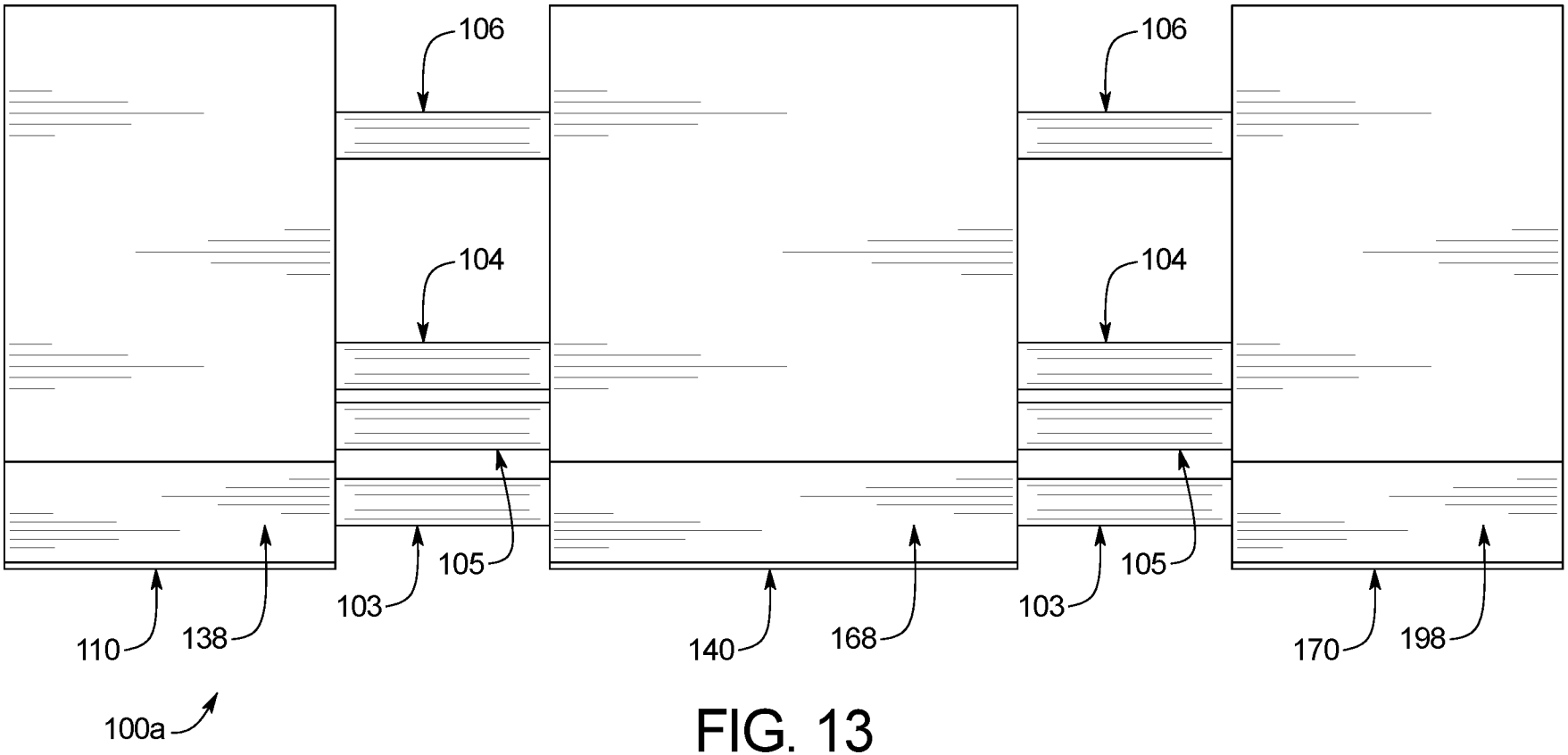
FIG. 13 is an enlarged bottom view of the multi-orientation coil/slab support of FIG. 9 in a coil supporting orientation.
Figure 15:
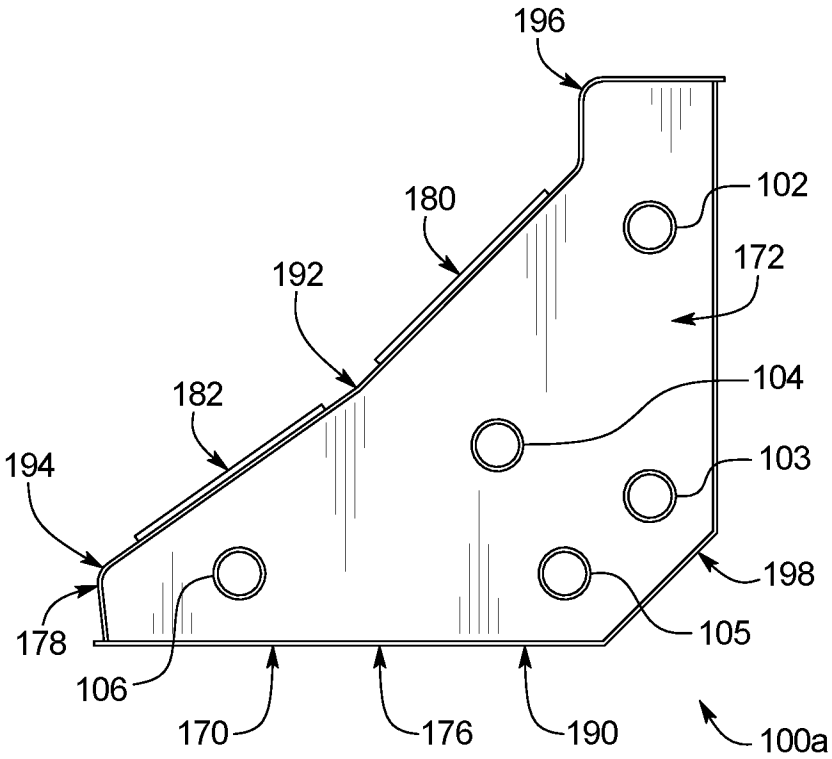
FIG. 15 is an enlarged second side view of the multi-orientation coil/slab support of FIG. 9 in a coil supporting orientation.
Figure 14:
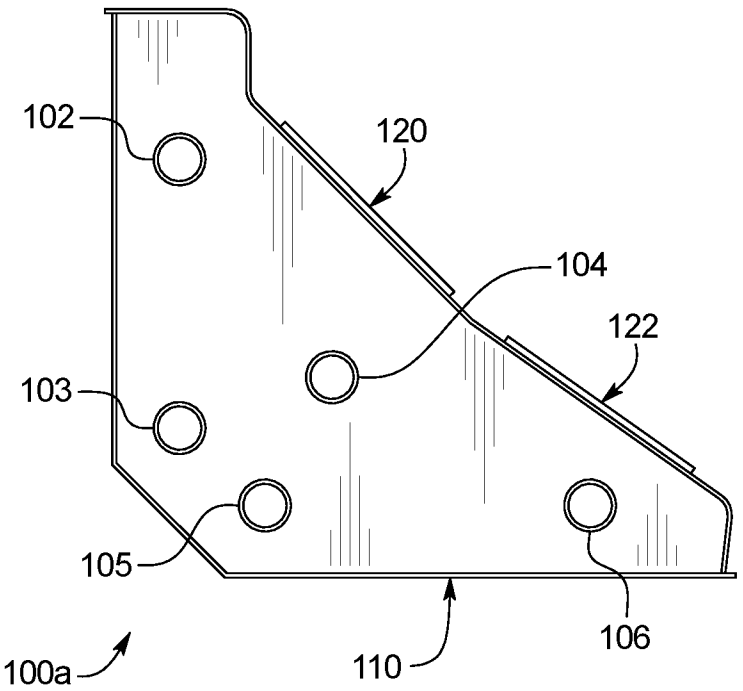
FIG. 14 is an enlarged first side view of the multi-orientation coil/slab support of FIG. 9 in a coil supporting orientation.
Figure 16:
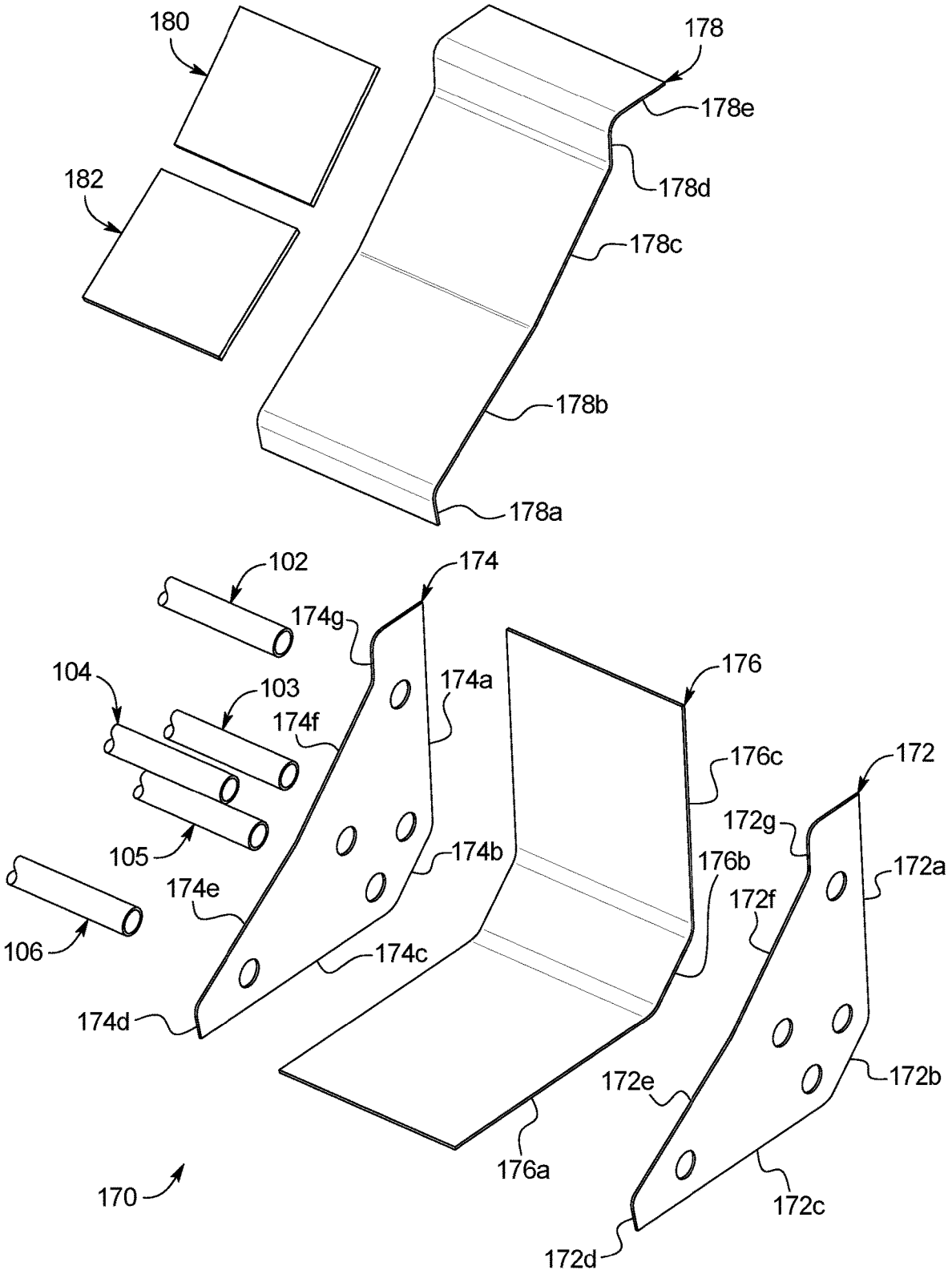
FIG. 16 is an enlarged exploded partially fragmentary perspective view of an end section of the multi-orientation coil/slab support of FIG. 9 in a coil supporting orientation.

For clarity in the Figures, only two of the support securements 90 and 92 are shown in FIG. 9. Any suitable quantity of support securements (such as two or four support securements) can be employed to securely attach each of the plurality of multi-orientation coil/slab supports 100*a*, 100*b*, 100*c*, 100*d*, 100*e*, 100*f*, 100*g*, 100*h*, 100*i*, and 100*j* in each of the desired positions and the desired orientations on the floor 50, depending on the desired usage of and products to be transported by the configurable railroad car 20. For example, FIG. 9 shows example support securements 90 and 92 securely attaching the multi-orientation coil/slab support 100*a* to the floor 50 in a coil supporting position and in a coil supporting orientation. In this example embodiment, two additional support securements (not shown) would also be employed to restrain the multi-orientation coil/slab support 100*a* to the floor 50 in this coil supporting position and coil supporting orientation of the multi-orientation coil/slab support 100*a*. Likewise, multiple support securements (not shown) would be employed to securely attach each multi-orientation coil/slab support to the floor in their respective slab supporting positions and slab supporting orientations (shown in FIGS. 6, 7, and 8). Likewise, multiple support securements (not shown) would be employed to securely attach each multi-orientation coil/slab support to the floor 50 adjacent to the respective end wall 70 or 80 in the storage positions and storages orientations (shown in FIGS. 1, 2, 6, 7, and 8).

In this illustrated example embodiment, each example support securement 90 and 92 includes a chain with one or more attachment hooks or other suitable attachment mechanisms (not shown) connected to that chain. As shown in FIG. 9, each support securement 90 and 92 is configured to extend over the respective connecting bars 102, 103, 104, 105, and 106 (described below) and extend through the respective elongated opening 56*a* or 56*b* in the floor 50 and securely suitably attached to the floor 50. It should be appreciated that in certain embodiments of the present disclosure, the support securements can be configured to lock the multi-orientation coil/slab supports in the respective positions and orientations, such as to prevent theft of these supports. It should also be appreciated that in certain embodiments of the present disclosure, the supports can themselves includes suitable locking devices to lock the multi-orientation coil/slab supports in the respective positions and orientations. It should further be appreciated that in certain embodiments of the present disclosure, additional locking devices can be provided to lock the multi-orientation coil/slab supports in the respective positions and orientations.

The end walls 70 and 80 may be any suitable end walls as are known in the railroad industry or that may be developed in the future. The first end wall 70 is suitably connected to and supported by the frame 22 and the floor 50 at a first end of the railroad car 20. Likewise, the second end wall 80 is suitably connected to and supported by the frame 22 and the floor 50 at an opposite second end of the railroad car 20.

The plurality of multi-orientation coil/slab supports 100*a*, 100*b*, 100*c*, 100*d*, 100*e*, 100*f*, 100*g*, 100*h*, 100*i*, and 100*j* in this illustrated example embodiment are all identical. However, the multi-orientation coil/slab supports do not need to be identical in accordance with the present disclosure. While ten multi-orientation coil/slab supports are shown in this illustrated example embodiment, the quantity of the multi-orientation coil/slab supports may vary in accordance with the present disclosure. In various embodiments, the quantity may depend on the length of the railroad car and/or the size of the coils. Since the multi-orientation coil/slab supports are identical in this illustrated example embodiment, for brevity, only multi-orientation coil/slab support 100*a* is described in more detail herein.

Referring now also to FIGS. 10, 11, 12, 13, 14, 15, and 16, in this illustrated example embodiment, the multi-orientation coil/slab support 100*a* includes: (1) a first end support section 110; (2) a center support section 140; (3) a second end support section 170; and (4) a plurality of connection bars 102, 103, 104, 105, and 106 that function as part of each of the first end support section 110, the center support section 140, and the second end support section 170, and that also fixedly connect the first end support section 110 to the center support section 140, and the center support section 140 to the second end support section 170. The connection bars 102, 103, 104, 105, and 106 in this example are each elongated cylindrical tubes; however, the connection bars may be otherwise suitably formed. In this illustrated example embodiment, the first end support section 110, the center support section 140 and the second end support section 170 are identical in construction except that the center support section 140 is wider than the first end support section 110 and wider than the second end support section 170. The relative sizes of these support sections and the quantity of these support sections may vary in accordance with the present disclosure. The first end support section 110, the center support section 140, and the second end support section 170 are configured to function to together when the multi-orientation coil/slab support 100*a* is a coil supporting position and a coil supporting orientation to partially support a coil such as steel coil C3 as shown in FIGS. 4 and 5. The first end support section 110, the center support section 140, and the second end support section 170 are also configured to function to together when the multi-orientation coil/slab support 100*a* is a slab supporting position and a slab supporting orientation to partially support one or more slabs such as elongated hot steel slabs S1, S2, S3, and S4 as shown in FIGS. 7 and 8. Since these support sections are identical in construction in this illustrated example embodiment, for brevity, only the construction of the second end support section 170 is described in detail herein, and it should be appreciated that the support sections 110 and 140 are constructed in a similar manner in this example embodiment of the present disclosure.

Example second end support section 170 includes: (1) a first supporting end wall 172; (2) a second supporting end wall 174; (3) a first outer wall 176; (4) a second outer wall 178; (5) end portions of the connecting bars 102, 103, 104, 105, and 106; (6) a first section of matting 180; and (7) a second section of matting 182. In this example embodiment, each of the first supporting end wall 172, the second supporting end wall 174, the first outer wall 176, the second outer wall 178, and the connecting bars 102, 103, 104, 105, and 106 are made from a suitably strong material such as steel. In such embodiments, these components are suitably connected by welds.

The first supporting end wall 172 is somewhat triangular and defines the overall shape of the second end support section 170. The first supporting end wall 172 includes edges 172*a*, 172*b*, 172*c*, 172*d*, 172*e*, 172*f*, and 172*g*. Although not shown, these edges 172*a*, 172*b*, 172*c*, 172*d*, 172*e*, 172*f*, and 172*g* engage and are suitably connected to the respective inner surfaces of the respective corresponding sections of the first outer wall 176 and the second outer wall 178 (such as by welding). The first supporting end wall 172 defines a plurality of connecting bar receiving openings (not labeled) through which the respective connecting bars 102, 103, 104, 105, and 106 extend. Although not shown, the connecting bars 102, 103, 104, 105, and 106 are suitably connected to the first supporting end wall 172 (such as by welding).

Similarly, the second supporting end wall 174 is somewhat triangular and defines the overall shape of the second end support section 170. The second supporting end wall 174 includes edges 174*a*, 174*b*, 174*c*, 174*d*, 174*e*, 174*f*, and 174*g*. Although not shown, these edges 174*a*, 174*b*, 174*c*, 174*d*, 174*e*, 174*f*, and 174*g* are suitably connected to the respective inner surfaces of the respective corresponding sections of the first outer wall 176 and the second outer wall 178 (such as by welding). The second supporting end wall 174 also defines a plurality of connecting bar receiving openings (not labeled) through which the respective connecting bars 102, 103, 104, 105, and 106 extend. Although not shown, the connecting bars 102, 103, 104, 105, and 106 are suitably connected to the second supporting end wall 174 (such as by welding).

The first outer wall 176 is somewhat L shaped and includes sections 176*a*, 176*b*, and 176*c*. These sections 176*a*, 176*b*, and 176*c* extend transverse to each other, and sections 176*a* and 176*c* extend perpendicular or substantially perpendicular to each other. Section 176*b*, and particularly it's flat outer surface, is configured to partially support the elongated hot steel slab S1 when the support 100*a* is in a slab supporting position and a slab supporting orientation such as shown in FIGS. 6, 7, and 8.

The second outer wall 178 is somewhat wing shaped and includes sections 178*a*, 178*b*, 178*c*, 178*d*, and 178*e*. These sections 178*a*, 178*b*, 178*c*, 178*d*, and 178*e* extend transverse to each other. Sections 178*b* and 178*c* are configured to partially support the coil C3 when the support 100*a* is in a coil supporting position and coil supporting orientation as shown in FIGS. 3, 4, 5, and 9. Sections 178*a* and 178*d* are configured to function as parts of bases 194 and 196 (described below) when the support 100*a* is in a slab supporting position and orientation as shown in FIGS. 6, 7, and 8.

The first section of matting 180 and the second section of matting 182 are both generally rectangular anti-skid matting suitably connected to the second out wall 178. In this example embodiment, the first section of matting 180 and the second section of matting 182 are both anti-skid matting. The anti-skid matting 180 and 182 are configured to: (1) provide a compressible material for the coil C3 to rest on; (2) increase friction between the outer surface of the coil C3 and the surface of the second outer wall 178 to inhibit lateral movement of the coil C3; and (3) assist in preventing scratching of the outer surface of the coil C3. Thus, the anti-skid matting 120, 122, 150, 152, 180, and 182 of the multi-orientation coil/slab support 100*a* are positioned in the coil supporting orientation to face upwardly for engagement by the Coil C3. On the other hand, the anti-skid matting 120, 122, 150, 152, 180, and 182 of the multi-orientation coil/slab support 100*a* are positioned in the slab supporting orientation to face downwardly away from the elongated hot steel slabs such as slab S1. This positioning of the anti-skid matting prevents the hot slabs from engaging such anti-skid matting and from causing any deformation of such anti-skid matting.

The first supporting end wall 172, the second supporting end wall 174, the first outer wall 176, the second outer wall 178, the end portions of the bars 102, 103, 104, 105, and 106, the first section of matting 180, and the second section of matting 182, are configured and suitably fixedly connected such that the second end support section 170 has: (1) a first base 190; (2) a coil support 192; (3) a second base 194; (4) a third base 196; and (5) a slab support 198. Similarly, the first end support section 110 has: (1) a first base 130; (2) a coil support 132; (3) a second base 134; (4) a third base 136; and (5) a slab support 138. Similarly, the center support section 140 has: (1) a first base 160; (2) a coil support 162; (3) a second base 164; (4) a third base 166; and (5) a slab support 168.

Generally, in a coil supporting position and a coil supporting orientation, the multi-orientation coil/slab support 100*a* rests on the first bases 130, 160, and 190 (that co-act to function as one first base for the multi-orientation coil/slab support 100*a*), and the coil (such as coil C3) rests on coil supports 132, 162, and 192 (that co-act to function as one coil support for the multi-orientation coil/slab support 100*a*). More specifically, when the second end support section 170 (and the entire the multi-orientation coil/slab support 100*a*) is in a coil supporting position and a coil supporting orientation on the floor 50 of the car 20 for supporting a coil (such as a steel coil C3) as shown in FIGS. 3, 4, 5, and 9, the second end support section 170 rests on the first base 190 and the coil support 192 is configured to be engaged by the coil. Similarly, when the first end support section 110 (and the entire the multi-orientation coil/slab support 100*a*) is in a coil supporting position and a coil supporting orientation on the floor 50 of the car 20 for supporting a coil (such as a steel coil C3) as shown in FIGS. 3, 4, 5, and 9, the first end support section 110 rests on the first base 130 and the coil support 132 is configured to be engaged by the coil. Similarly, when the center support section 140 (and the entire the multi-orientation coil/slab support 100*a*) is in a coil supporting position and a coil supporting orientation first orientation on the floor 50 of the car 20 for supporting a coil (such as a steel coil C3) as shown in FIGS. 3, 4, 5, and 9, the center support section 140 rests on the first base 160 and the coil support 162 is configured to be engaged by the coil.

Generally, in a slab supporting position and a slab supporting orientation, the multi-orientation coil/slab support 100*a* rests on the second and third bases 134, 136, 164, 166, 194, and 196 (that co-act to function as second and third bases for the multi-orientation coil/slab support 100*a*), and that the slab (such as slab S1) rests on slab supports 138, 168, and 198 (that co-act to function as a slab support for the multi-orientation coil/slab support 100*a*). More specifically, when the second end support section 170 (and the entire the multi-orientation coil/slab support 100*a*) is in a slab supporting position and slab supporting orientation on the floor 50 of the car 20 for supporting one of more elongated hot steel slabs (such as steel slabs S1, S2, S3, and S4) as shown in FIGS. 6, 7, and 8, the second end support section 170 rests on the second base 194 and the third base 196, and the slab support 198 is configured to be engaged by the lowermost slab S1. Similarly, when the first end support section 110 (and the entire the multi-orientation coil/slab support 100*a*) is in a slab supporting position and slab supporting orientation on the floor 50 of the car 20 for supporting one of more elongated hot steel slabs (such as steel slabs S1, S2, S3, and S4) as shown in FIGS. 6, 7, and 8, the first end support section 110 rests on the second base 134 and the third base 136, and the slab support 138 is configured to be engaged by the lowermost slab S1. Similarly, when the support section 140 (and the entire the multi-orientation coil/slab support 100*a*) is in a slab supporting position and slab supporting orientation on the floor 50 of the car 20 for supporting one of more elongated hot steel slabs (such as steel slabs S1, S2, S3, and S4) as shown in FIGS. 6, 7, and 8, the support section 140 rests on the second base 164 and the third base 166, and the slab support 168 is configured to be engaged by the lowermost slab S1.

When the multi-orientation coil/slab supports 100*a*, 100*b*, 100*c*, 100*d*, 100*e*, 100*f*, 100*g*, 100*h*, 100*i*, and 100*j* are in stacked positions and stacked orientations at respective ends of the railroad car adjacent to one of the end walls 70 or 80, as shown in FIGS. 1, 2, and 3, each of the multi-orientation coil/slab supports 100*a*, 100*b*, 100*c*, 100*d*, 100*e*, 100*f*, 100*g*, 100*h*, 100*i*, and 100*j* may be in either one of two different orientations as shown in FIGS. 1, 2, and 3 in this example embodiment. In this example embodiment, the multi-orientation coil/slab supports 100*a*, 100*c*, and 100*e* are stacked in a first stacking orientation adjacent second end wall 80, the multi-orientation coil/slab supports 100*b* and 100*d* are stacked in a second stacking orientation adjacent second end wall 80, the multi-orientation coil/slab supports 100*f*, 100*h*, and 100*j* are stacked in a first stacking orientation adjacent to first end wall 70, and the multi-orientation coil/slab supports 100*g* and 100*i* are stacked in a second stacking orientation adjacent to first end wall 70. The first set of the stacked multi-orientation coil/slab supports 100*a*, 100*b*, 100*c*, 100*d*, and 100*e* are securely attachable to the floor 50, the frame 20, and/or the second end wall 80 by a suitable quantity (such as four) of the support securement (like support securements 90 and 92). Likewise, the second set of the multi-orientation coil/slab supports 100*f*, 100*g*, 100*h*, 100*i*, and 100*j* are securely attachable to the floor 50, the frame 20, and/or the second end wall 80 by a suitable quantity (such as four) of the support securements (like support securements 90 and 92).

Sets of the multi-orientation coil/slab supports 100*a*, 100*b*, 100*c*, 100*d*, 100*e*, 100*f*, 100*g*, 100*h*, 100*i*, and 100*j* can be stacked for storage in other suitable orders, positions, and orientations. For example, the first set of multi-orientation coil/slab supports 100*a*, 100*b*, 100*c*, 100*d*, and 100*e*, can be stacked in the storage orientation adjacent to second end wall 80, and second set of the multi-orientation coil/slab supports 100*f*, 100*g*, 100*h*, 100*i*, and 100*j* can be stacked in the storage orientation adjacent to first end wall 70.

The present disclosure further contemplates that two or more of the multi-orientation coil/slab supports of the present disclosure can be employed with other suitable transport vehicles such as but not limited to a flatbed truck or trailer. In such cases, the multi-orientation coil/slab supports can be repositioned and re-orientated on the floor of the truck or trailer and securely attaching the coil/slab supports in each of the respective positions. More specifically, the multi-orientation coil/slab supports can be in: (1) coil supporting or first positions and coil supporting or first orientations on the floor of the truck or trailer and securely attached to the floor of the truck or trailer to transport coils; (2) slab supporting or second positions and slab supporting or second orientations on the floor and securely attached to the floor of the truck or trailer to transport elongated slabs; or (3) stacked or third positions and stacked or third orientations on the floor and securely attached to the floor of the truck or trailer to transport other products.

It will be understood that modifications and variations may be effected without departing from the scope of the novel concepts of the present invention, and it is understood that this application is to be limited only by the scope of the claims.

The invention claimed is:

1. A railroad car comprising:

a frame;

a floor connected to and supported by the frame;

a plurality of multi-orientation coil/slab supports each having a same shape and configuration and positionable in: (a) coil supporting positions and coil supporting orientations on the floor to support at least one coil, and (b) slab supporting positions and slab supporting orientations on the floor positions to support at least one elongated slab, wherein for each of the multi-orientation coil/slab supports, the coil supporting orientation is different than the slab supporting orientation; and a plurality of support securements configured to selectively restrain: (a) the plurality of multi-orientation coil/slab supports in the coil supporting positions and the coil supporting orientations on the floor, and (b) the plurality of multi-orientation coil/slab supports in the slab supporting positions and the slab supporting orientations on the floor.

2. The railroad car of claim 1, which includes a first end wall supported by the frame.

3. The railroad car of claim 2, wherein the plurality of multi-orientation coil/slab supports are positionable in stacked positions and stacked orientations on the floor adjacent the first end wall.

4. The railroad car of claim 3, wherein the plurality of support securements are configured to restrain the plurality of multi-orientation coil/slab supports in the stacked positions and the stacked orientations to the floor.

5. The railroad car of claim 1, which includes a first end wall supported by the frame and a second end wall supported by the frame, wherein the plurality of multi-orientation coil/slab supports are positionable in stacked positions and stacked orientations on the floor adjacent to each of the first end wall and the second end wall.

6. The railroad car of claim 5, wherein the plurality of support securements are configured to restrain the plurality of multi-orientation coil/slab supports in the stacked positions and the stacked orientations to the floor.

7. The railroad car of claim 1, wherein the plurality of multi-orientation coil/slab supports are simultaneously positionable in a combination of: (a) coil supporting positions and coil supporting orientations on the floor to support at least one coil, and (b) slab supporting positions and slab supporting orientations on the floor positions to support at least one elongated slab.

8. The railroad car of claim 1, wherein at least one of the plurality of multi-orientation coil/slab supports has a first base, a coil support, a second base, a third base, and a slab support, and wherein in the coil supporting position and the coil supporting orientation, said multi-orientation coil/slab support is configured to rest on the first base and the coil support faces upwardly, and in the slab supporting position and the slab supporting orientation, the multi-orientation coil/slab is configured to rest on the second and third bases, the slab support faces upwardly, and the coil support faces downwardly.

9. A railroad car comprising:

a frame;

a floor connected to and supported by the frame;

a plurality of multi-orientation coil/slab supports positionable in: (a) coil supporting positions and coil supporting orientations on the floor to support at least one coil; and (b) slab supporting positions and slab supporting orientations on the floor positions to support at least one elongated slab, wherein at least one of the multi-orientation coil/slab supports includes a first end support section, a center support section, a second end support section, and a plurality of connection bars that are part of each of the first end support section, the center support section, and the second end support section, and that fixedly connect the first end support section to the center support section, and the center support section to the second end support section; and a plurality support securements configured to selectively restrain: (a) the plurality of multi-orientation coil/slab supports in the coil supporting positions and the coil supporting orientations on the floor; and (b) the plurality of multi-orientation coil/slab supports in the slab supporting positions and the slab supporting orientations on the floor.

10. The railroad car of claim 9, wherein at least one of the support sections includes a first supporting end wall, a second supporting end wall, a first outer wall, a second outer wall, and portions of the connection bars.

11. The railroad car of claim 9, wherein at least one of the support sections has a first base, a coil support, a second base, a third base, and a slab support, and wherein in the coil supporting position and the coil supporting orientation, said support section is configured to rest on the first base and the coil support faces upwardly, and in the slab supporting position and the slab supporting orientation, the support section is configured to rests on the second and third bases, the slab support faces upwardly, and the coil support faces downwardly.

12. A multi-orientation coil/slab support comprising:

a first end support section;

a center support section;

a second end support section;

wherein each of the first end support section, the center support section, and the second end support section forms part of:

a first base, a coil support, a second base, a third base, and a slab support; and a plurality of connection bars that are part of each of the first end support section, the center support section, and the second end support section, and that fixedly connect the first end support section to the center support section, and the center support section to the second end support section, wherein the multi-orientation coil/slab support is positionable in: (a) a coil supporting position and a coil supporting orientation on a floor to partially support a coil, and (b) a slab supporting position and a slab supporting orientation on the floor to partially support an elongated slab, wherein (a) in the coil supporting position and the coil supporting orientation, each of the multi-orientation coil/slab supports is configured to rest on the first base thereof and the coil support thereof faces upwardly, and (b) in the slab supporting position and the slab supporting orientation, each of the multi-orientation coil/slab supports is configured to rest on the second and third bases thereof, the slab support thereof faces upwardly, and the coil support thereof faces downwardly.

13. The multi-orientation coil/slab support of claim 12, wherein at least one of the support sections includes a first supporting end wall, a second supporting end wall, a first outer wall, a second outer wall, and portions of the connection bars.

14. The multi-orientation coil/slab support of claim 12, which includes a plurality of anti-skid mattings attached to the first end support section, the center support section, and the second end support section, such that when the multi-orientation coil/slab support is in the coil supporting position and the coil supporting orientation, the anti-skid mattings face upwardly and are configured to be engaged by the coil, and when the multi-orientation coil/slab support is in the slab supporting position and the slab supporting orientation, the anti-skid mattings face downwardly and are configured to be spaced apart from the elongated slab.

15. A multi-orientation coil/slab support comprising:

a plurality of support sections and a plurality of connection bars that are part of each of the support sections, and that fixedly connect the support sections;

each of the support sections forming:

a first base;

a coil support;

a second base;

a third base; and a slab support, wherein the multi-orientation coil/slab support is positionable in: (a) a coil supporting position and a coil supporting orientation with the first bases on a floor and the multi-orientation coil/slab support configured to partially support a coil, and (b) a slab supporting position and a slab supporting orientation with the second and third bases on the floor and the multi-orientation coil/slab support configured to partially support an elongated slab.

16. The multi-orientation coil/slab support of claim 15, wherein each of the plurality of support sections includes part of the first base, part of the coil support, part of the second base, part of the third base, and part of the slab support.

17. The multi-orientation coil/slab support of claim 15, which includes a section of matting attached to the coil support such that when the multi-orientation coil/slab support is in the coil supporting position and the coil supporting orientation, the section of matting faces upwardly and is configured to be engaged by the coil, and when the multi-orientation coil/slab support is in the slab supporting position and the slab supporting orientation, the section of matting faces downwardly and is configured to be spaced apart from the elongated slab partially supported by the slab support.

* * * * *